United States Patent [19]

Plummer et al.

[11] Patent Number: 4,976,066

[45] Date of Patent: Dec. 11, 1990

[54] SLIDING WINDOW APPARATUS AND METHOD

[75] Inventors: David D. Plummer, Hudson, Wis.; Hartmut Ginnow-Merkert, Orono, Minn.

[73] Assignee: Andersen Corporation, Bayport, Minn.

[21] Appl. No.: 351,779

[22] Filed: May 15, 1989

[51] Int. Cl.[5] ..... E05D 15/10

[52] U.S. Cl. ..... 49/225; 49/219

[58] Field of Search ..... 49/225, 223, 221, 218, 49/219, 209, 130; 16/87 R, 92; 52/207

[56] References Cited

U.S. PATENT DOCUMENTS

| | | | |
|---|---|---|---|
| 3,209,411 | 10/1965 | Sprague, Jr. | 49/225 |
| 3,538,642 | 11/1970 | Fredricksen | 49/213 |
| 3,660,936 | 5/1972 | Bryson | 49/209 |
| 3,807,092 | 4/1974 | Dorey | 49/225 |
| 4,240,226 | 12/1980 | Georgelin | 49/225 X |
| 4,341,043 | 7/1982 | Yamamoto et al. | 49/225 X |
| 4,384,429 | 5/1983 | Rokicki et al. | 49/219 X |
| 4,503,638 | 3/1985 | Schindehutte | 49/213 |
| 4,551,945 | 11/1985 | von Resch | 49/221 |
| 4,682,455 | 7/1987 | Klompenburg | 52/207 |

*Primary Examiner*—Philip C. Kannan

*Attorney, Agent, or Firm*—Merchant, Gould, Smith, Edell, Welter & Schmidt

[57] ABSTRACT

An improved apparatus and method of sliding window construction are disclosed. When moving in an open position, a sash member is guided for movement in a first plane generally parallel to the window frame opening. When moving toward closure, the sash is guided by rotatable glide members that simultaneously transversely move all four corners of the sash into closure under cam action of the glides, to uniformly compress a weatherstrip seal around the entire perimeter of the sash. The transverse movement between open and closed positions can be performed in a manner such that the general plane of the sash remains parallel to the first plane throughout the transverse movement phase. Means are provided for retainably maintaining the sash at discrete positions along the transverse path of the sash during closure.

14 Claims, 4 Drawing Sheets

FIG. 1
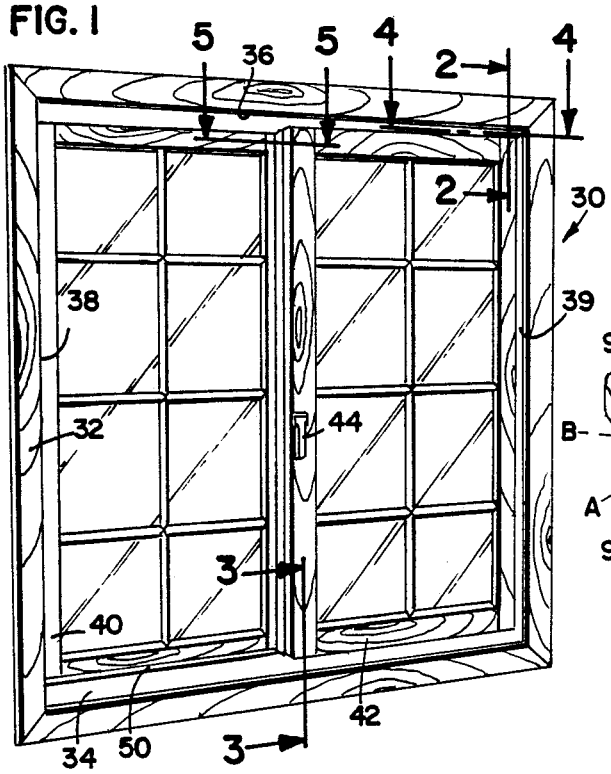
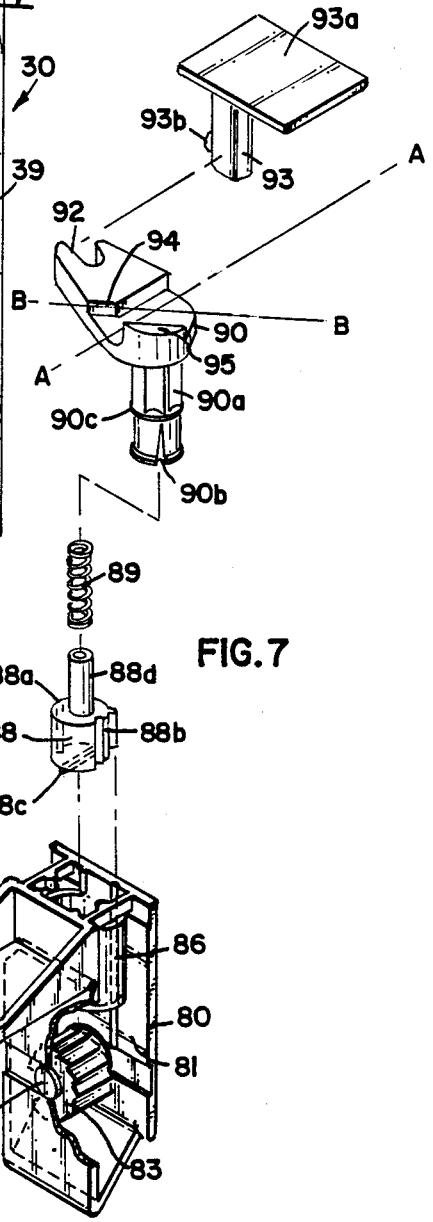
FIG. 7
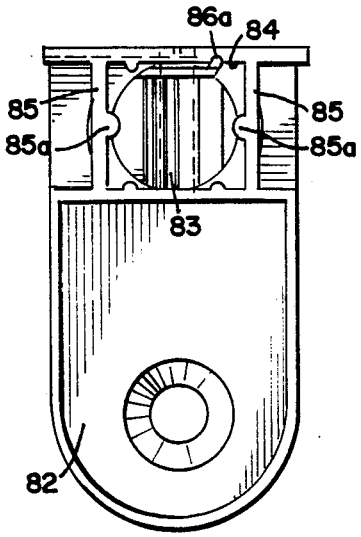
FIG. 8

40
48
48a
43
93
90
A
B
C
D
70
SECOND MOVEMENT ZONE
Z
FIRST MOVEMENT ZONE

SLIDING WINDOW APPARATUS AND METHOD

BACKGROUND OF THE INVENTION

1. Field of the Invention

This invention relates generally to window construction, and more specifically, to an improved configuration for moving the sash members of sliding sash windows for effecting superior sealing properties.

2. Cross-Reference to Related Patents

To the extent disclosures in U.S. Pat. No. 3,538,642 issued on Nov. 10, 1970, to Fredricksen are necessary for understanding this invention, they are herein incorporated by reference into this document.

3. Description of the Art

The most popular window configurations having movable sashes are the casement, the double-hung and the sliding or gliding types of windows. Besides their different aesthetic properties, each has unique functional characteristics that must be considered when selecting the proper type of window for the desired application. For example, a casement window which is typically mounted for hinged movement about a vertical axis along one edge of the window is easily opened by means of a simple crank lever and has characteristically offered an excellent weathertight seal between the movable sash and the window frame. However, such windows have the disadvantage of opening outward, thereby being susceptible to damage, requiring extended eave overhang protection, and typically require insect screens to be located on the inside of the window frame, a condition which allows for undesirable collection of insects and debris between the screen and the sash.

Double-hung windows generally include a pair of sash members which move vertically within a weatherstripped frame member. Biasing or counterweight means located within or on the frame of the window are typically used to facilitate operator movement of the sashes. Insect screens and/or additional fixed glazing panels can be mounted on the outside of the window. Due to the slidable property of the window relative to its weatherstripping, the doublehung window does not generally enjoy the same weathertight seal properties of a casement window.

Sliding or gliding windows generally include a pair of sash members one or both of which are horizontally movable within a frame. As with the double-hung type of window, an insect screen or additional glazings can be mounted on the outside portion of the window frame. Generally, only one of the sash members is moved at a time, as directed by guides or tracks formed within or extending from the upper and lower jamb portions of the window frame. Because of the sliding nature of this type of window and the difficulty in providing a tight seal between the two sash members, the sliding window has generally not been as weathertight as its casement counterpart.

It is desirable in a sliding window configuration to maintain a separation spacing between the window sashes when moved relative to one another, so as to minimize frictional wear to and damage of the weatherstripping parts during the sash movement process. Another desirable feature for a sliding window is that the moving sash slide or glide relatively freely with respect to the track or guide, and not require undo pressure or strain to be exerted by an operator to open, close or lock the window into sealed closure. Further, the track or guide and any moving parts associated with moving the window along such track or guide should be highly reliable and relatively maintenance free. It is also desirable to design the sliding window in a manner such that its weathertightness properties equal or approach those of a casement window.

While a number of sliding window configurations are known, none has displayed the unique combination of properties and design attributes which simultaneously satisfy the above design goals for a sliding window. For example, early sliding window configurations employed recessed tracks in the upper and lower window frame members along which the movable sash members moved as directed by guide pins projecting from the top and bottom of the movable sash members. The tracks were obliquely aligned with respect to the window frame so as to enable the movable sash to simultaneously travel longitudinally along the window frame and in a direction away from the other sash member so as to prevent frictional engagement with the second sash member during movement. The recessed groove required excessive cleaning and maintenance, was susceptible to rapid operative degradation and was difficult to seal.

A later development, disclosed in cross-referenced U.S. Pat. No. 3,538,642 eliminated the problems associated with a recessed groove guide by providing an extruded self-cleaning track on the window frame sill for directing movement of the window sash therealong as assisted by stationary glide mechanisms mounted within the bottom portions of the movable sash members. The extruded track was self-cleaning in nature and was segmented into four different sections having varied elevations and angles so as to direct the movable sash into sealing engagement at closure and away from the adjacent sash during sliding movement in the open position. While this invention provided many advantages over earlier sliding window designs, due to the curved and segmented nature of the track, excessive operator pressure could at times be required to properly move the sash member along its intended path. Further, since the extruded guide member was only used along the bottom of the window frame, the closure seal along the upper portion of the window was not as weathertight as desired.

A more recent sliding window design is illustrated by U.S. Pat. No. 4,682,455 which also uses an extruded guide for directing a movable window sash member carried by a roller carriage assembly. The window assembly of this design uses compression seals, but requires an operator to impart the required compression force to the seals by physically pulling the window sash at its closure position in a direction transverse to the longitudinal movement of the window.

Therefore, while each of the prior art sliding window configurations satisfies one or more of the desired design attributes for a sliding window, none has provided a design which collectively satisfies all of the desired design attributes at the same time. It is believed that the present invention does so. The present invention provides a self-cleaning, relatively maintenance-free straight guide track. The movable sash members of the sliding window of this invention are carried by low-friction glide members which require minimal operator effort to move the sash members along the guide or track. The glide members are uniquely configured to cam and hold an entire movable window sash member into compressive sealing engagement at the point of closure, as a logical extension of the longitudinal movement of the window within the frame, and without requiring additional pulling motion by the operator. The weathertightness of the seal provided by the structural design of the window of this invention compares favorably with that provided by a casement type of window.

SUMMARY OF THE INVENTION

The present invention provides a design for a sliding window having one or more sliding sash members that cooperatively move to a closed position in a manner enabling a tight compressive seal between the sashes and the frame to provide weathertightness properties comparable to those of casement windows. The invention enables the use of simple linear guide tracks aligned parallel to the window frame, thereby simplifying and reducing the cost to manufacture the frame and guide track portions of the window assembly. The invention is particularly applicable to extruded guide track configurations which are preferred for low-maintenance and high-reliability. The movable sash members are supported between the opposed guide tracks by means of a plurality of glide members which are protectively mounted at the corners of the upper and lower edges of the movable sash members so as to prevent damage to their moving parts and to shield them from harmful environmental elements. The glide members cooperatively engage and ride along the opposed track guides and are configured to eccentrically rotate between two cam positions, as determined by the longitudinal position of the moving sash within the window frame. When the window is moving in a first movement zone which covers all movement of the window except for approximately the last inch of closure, the glide members carrying the sash are rotatably positioned at a first position, to carry the window sash in a first plane, longitudinally along the frame and in a spaced-apart relation with the other sash member(s) of the window.

When the window sash is approaching closure and is moving within a second movement zone, means are provided for engaging and rotating the glide members of that sash toward a second position wherein the guide tracks engage a second cam surface of the respective glide members. As the glide members are rotated between their first and second cam positions, the guide tracks exert bearing forces through the glide cam surfaces to the moving window sash which cause the sash to move transversely to the guide tracks from the first plane of motion to a second plane representing the closure position of the sash. The plurality of glide members of the moving sash are simultaneously engaged and rotated such that the window sash always remains parallel to the first plane as it transversely moves between the first and second planes in the second movement zone. Engagement and rotation of the glide members automatically occur as an operator slides the window sash toward closure such that the operator need only provide longitudinal closing pressure to the window sash to effect complete closure of the window. The transverse motion provided by the glide members to the entire window sash in the relatively short second movement zone during final closure of the window enables bulb-type weatherstripping materials to be applied between the window sash(es) and the frame so as to provide a tight compressive seal between the window sashes and between the sashes and the frame. This is in contrast to prior art techniques wherein final closure of a sash requires pivoting of the sash about one of its ends.

According to one aspect of the invention, there is provided a window apparatus for controllably directing sliding motion of a window sash within a frame, comprising:

(a) mounting means for operatively mounting a window sash for sliding movement within a window frame;

(b) first guide means operatively connecting the window sash and the frame for guiding and moving the window sash substantially in a first plane longitudinally of the frame when the sash is moving within a first movement zone; and (c) second guide means operatively connecting the window sash and the frame for guiding and moving the window sash in a direction transverse to the longitudinal motion, between the first plane and a second plane, when the sash is moving within a second movement zone. The first and second planes are substantially parallel and the second guide means operates to move the sash in a manner such that the general plane of the sash always lies parallel to the first plane during the transverse motion of the sash within the second movement zone.

According to a preferred embodiment of the invention, the first guide means includes a pair of guide tracks on oppositely disposed sides of the frame and slidable glide members mounted on the sash to cooperatively engage the opposed guide tracks. According to a preferred configuration of the invention, the second guide means includes a plurality of pivotal glide members mounted on the sash, and actuator lever means arranged and configured to engage the pivotal glide members for pivoting the glide members about their respective pivot axes as the sash moves in the second movement zone, thereby automatically transversely moving said sash toward said second plane. In a preferred configuration of the invention, the second guide means also includes retainer means for maintaining the moving sash in sealing engagement with the frame in the second plane, until the sash is moved by externally applied force, in a direction toward the first movement zone.

According to a second aspect of the invention, there is provided a method of moving a window sash between and relative to a pair of oppositely disposed guide tracks of a window frame comprising the steps of:

(a) longitudinally moving the sash in a first plane between oppositely disposed window frame guide members when the sash is longitudinally positioned between a fully opened position and a second nearly closed position; and (b) transversely moving said sash to a second plane generally parallel to the first plane when the sash is longitudinally positioned between the second position and a third, closed position, wherein the general plane of the sash remains substantially parallel to said first plane throughout the transverse motion thereof.

According to yet another aspect of the invention, there is provided a window construction of the type having at least one movable window sash comprising:

(a) a frame having a sill;

(b) at least one sash mounted for sliding movement in the frame;

(c) a first guide track on the frame for slidably supporting the sash and for directing movement of the bottom of the sash along said frame wherein the first guide track projects above the sill and longitudinally extends therealong;

(d) a second guide track on the frame in generally opposed relation to the first guide track for directing longitudinal movement of the top of the sash along the frame; and (e) glide means cooperatively mounting the sash between the first and second guide tracks for moving the sash along and between the opposed tracks, wherein the glide means is operable in a first movement zone of the frame to guide the sash for movement along the tracks in a first plane and is operable in a second movement zone of the frame when the sash approaches a closure position to automatically transversely move the entire sash to a second plane parallel to the first plane in a manner such that the general plane of the sash remains substantially parallel to the first plane during the transverse motion.

The invention contemplates that if the window contains more than one window sash, the movable sash longitudinally moves in the first movement zone in spaced relationship to the second sash. The invention further contemplates the glide means comprising a plurality of glide members having glide surfaces respectively contoured to form cam surfaces for bearing against the guide tracks, and means for rotating the glide surfaces about their respective pivot axes.

According to another aspect of the invention, there is provided a glide member for attachment to a sliding window sash, comprising:

(a) a housing configured for attachment to an edge of a window sash;

(b) a rotatable glide bearing defining a glide surface, the glide bearing having a stem portion rotatably supported by the housing and the glide surface being shaped to cooperatively engage and follow a guide track surface; and (c) retaining means cooperatively connected with the stem for restraining rotational movement of the stem within the housing, wherein rotation of the stem is retainably maintained at predetermined rotational angles about the stem axis.

According to a further aspect of the invention, the glide member further includes means operatively connected with the stem for adjusting the longitudinal position of the stem relative to the housing such that the glide surface can be adjustably raised or lowered relative to the housing. According to a preferred embodiment of the invention, the height adjustment feature is performed by means of a cam member. According to yet a further aspect of the invention, the glide member includes bias means for urging the glide surface outwardly from the housing in the longitudinal direction of the stem. According to yet another aspect of the invention, the glide member includes receptor means for cooperatively engaging a pawl member for rotating the glide bearing member about its stem. According to yet another aspect of the invention, the glide bearing surface is contoured to form a cam surface for bearing against a guide track surface of a window frame wherein the cam surface is eccentrically positioned relative to the glide member stem such that bearing forces applied to the cam surface are transmitted through the glide member housing to the window sash to which the glide member is secured.

While the invention will be described with respect to a preferred embodiment window configuration having a specific frame and sash configuration, it will be understood that the invention is not limited to such window or sash configurations but that the general principles of the invention apply to all sliding window arrangements. Further, while the invention will be described with respect to its applicability to guiding and controlling the movement of movable window sashes, it will be understood by those skilled in the art that its principles could be applied as well to the movement control of door panels. It will also be understood that while the invention will be described with regard to a particular number and orientation of glide members, the invention is not limited to either the number or particular orientation of glide members as depicted with reference to the preferred embodiment. Further, while the glide members illustrated with reference to the preferred embodiment of the invention illustrate particular cam configurations, retaining means and pawl activation techniques, the invention is not limited to any of the specifics of construction of the glide members, including the materials that are used to construct the glide or guide members of the preferred embodiment, other than as described within the appended claims. These and other variations of the invention will become apparent to those skilled in the art upon a more detailed description of the invention.

BRIEF DESCRIPTION OF THE DRAWING

Referring to the Figures, wherein like numerals represent like parts throughout the several views:

FIG. 1 is a front perspective view illustrating a typical dual sash sliding window configuration constructed according to the principles of this invention, as viewed from the interior side of the window with the window sashes locked in closed position;

FIG. 7 is an exploded fragmentary perspective view of a glide member and related activation pawl member of the window assembly illustrated in FIGS. 1–5; and FIG. 8 is an enlarged top plan view of the glide member illustrated in FIG. 7.

DESCRIPTION OF THE PREFERRED EMBODIMENT

Figure 2:
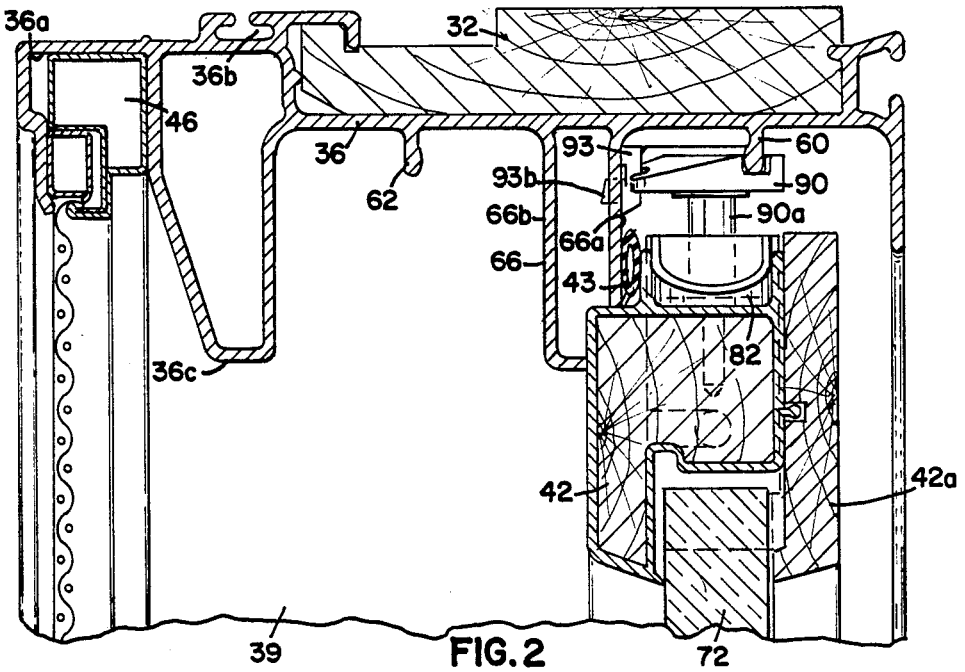
FIG. 2 is a cross-sectional view of the upper right-hand corner of the window assembly of FIG. 1, as generally viewed along the Line 2—2 of FIG. 1.

Referring to FIG. 1, a preferred embodiment construction of a sliding window assembly incorporating the principles of the present invention is generally designated at 30. It will be understood that while a particular window assembly will be described with regard to the preferred embodiment of the invention, except to the extent that features of the window assembly 30 are incorporated in the claims, the following detailed description of the window assembly 30 is not intended to restrict the claims. All and any variations from the preferred embodiment which fall within the scope and spirit of the appended claims are intended to be embraced by the claims. The window assembly 30 is illustrated in FIG. 1 as it would appear from the interior surface of the window. The window generally includes a frame 32 having a sill 34, a head 36 and a pair of oppositely disposed jambs 38 and 39. The frame 32 forms a rectangular sash opening into which two sashes 40 and 42 are mounted. In many sliding window assemblies such as that illustrated in FIG. 1, one of the sash members is permanently fixed while the other is slidably movable within the frame opening. In the preferred embodiment, both sashes 40 and 42 are mounted for slidable movement within the sash opening; however, it will be understood that the principles of the invention would apply as well to a window assembly having one or any number of movable sashes. The sashes 40 and 42 are illustrated in FIG. 1 as they would appear in a locked, closed position, forming a closure seal of the rectangular opening defined by the frame 32.

The centrally aligned vertical frame portions of the sashes 40 and 42 are locked together as illustrated in FIG. 1 by an appropriate sash latch assembly, generally designated at 44. The latch assembly 44 may be of any appropriate configuration well-known to those skilled in the art such as that illustrated in FIGS. 13–16 of U.S. Pat. No. 3,538,642 to Fredricksen which is assigned to the common assignee of this invention. To the extent that the details of construction of such a sash latch assembly 44 are relevant to an understanding of this invention, the description of such a latch assembly as illustrated and described in U.S. Pat. No. 3,538,642 is hereby incorporated by reference as though it were fully described herein. In general, such a latching mechanism would include a lever mechanism mounted on the sash 42 having an operator arm activated by the lever assembly for cooperatively engaging and locking with a bar or receptor member aligned with the engaging lever and secured to the sash 40. To the extent that a further description of such latching assembly is sought, the reader is referred to the above-referenced patent.

Referring to FIGS. 2–5, the core frame material generally designated at 32 is formed of wood and is covered by an extruded configuration representing the various identified parts of the frame (i.e., the sill 34, the head 36, and the jambs 38 and 39). In the preferred embodiment, the extruded covering material secured to the frame 32 is aluminum; however, it will be understood that other materials such as wood or vinyl could equally well be used. The extruded frame portions 34, 36, 38 and 39 are fastened to and form an extension of the underlying wooden frame core material 32.

Figure 3:
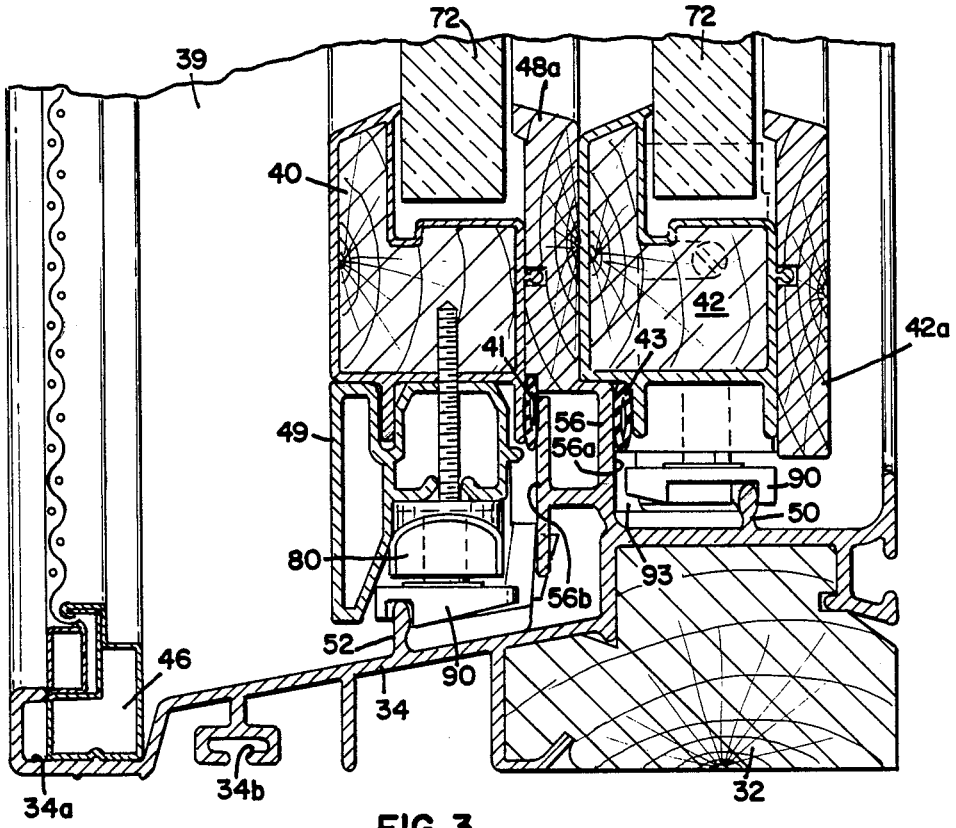
FIG. 3 is a cross-sectional view of the central lower sill portion of the window assembly of FIG. 1 as generally viewed along the Line 3—3 of FIG. 1.

Referring to FIG. 3, the lower sill 34 has a first upwardly extending self-cleaning three-dimensional extruded guide track 50 longitudinally running along the length of the sill at a position equally spaced from the inwardly directed edge of the sill 34. The "inner" guide track 50 supports the inner sash 42 as will be described in more detail hereinafter. Although guide track 50, as well as other guide tracks to be hereinafter described, could be made from other materials, it is preferable that the track be formed as an integral part of sill 34. Sill 34 further has a second upwardly extending, self-cleaning, threedimensional extruded guide track 52 similar in nature to guide track 50, longitudinally extending the length of the sill 34 and parallel thereto. "Outer" guide track 52 cooperatively supports sash 40 for sliding movement therealong as hereinafter described in more detail. Interposed between the guide tracks 50 and 52 and longitudinally extending the length of sill 34 is a parting stop 56 characterized by inner and outer surfaces **56*a* and 56*b* respectively. The outermost portion of sill 34 forms a recessed groove, generally designated at 34*a* for retainably holding the peripheral frame of an insect screen generally designated at 46. The groove-defining portion 34*b* extending from the lower portion of the sill 34** is configured to retainably hold a nailing flange member (not illustrated) as is well-known in the art.

Referring to FIG. 2, the upper head extrusion 36 overlies and is secured to the frame core 32. The head 36 includes a first downwardly extending three-dimensional extruded guide track 60 longitudinally extending the length of the head and equally spaced therealong from the inwardly directed edge of the head 36. The inner guide track 60 is configured to cooperatively guide movement of the sash 42 as is hereinafter described in more detail. The head 36 further has a second downwardly extending three-dimensional extruded guide track 62 longitudinally extending the length of the head and aligned parallel with the inner guide track 60. The outer guide track 62 is configured to cooperatively guide movement of the sash 40 therealong. The head 36 further has a downwardly extending parting stop extension generally designated at 66, and defining inner and outer parting stop surfaces **66*a* and 66*b*** respectively.

The cavity formed between the inner and outer portions of the lower and upper parting stops 56 and 66 respectively act as pressure equalization chambers to reduce wind turbulence and noise in the window assembly. The outermost end of the head 36 defines a groove generally designated at **36*a* for retainably holding the frame 46 of an insect screen. A nailing flange groove 36*b* is formed on the upper outer edge of the head 36, and a weather-protective extension 36*c* depends downwardly from the head 36 at a position spaced outwardly from the parting stop 66 so as to enable unimpeded passage of the sash 40** therebetween.

Figure 4:
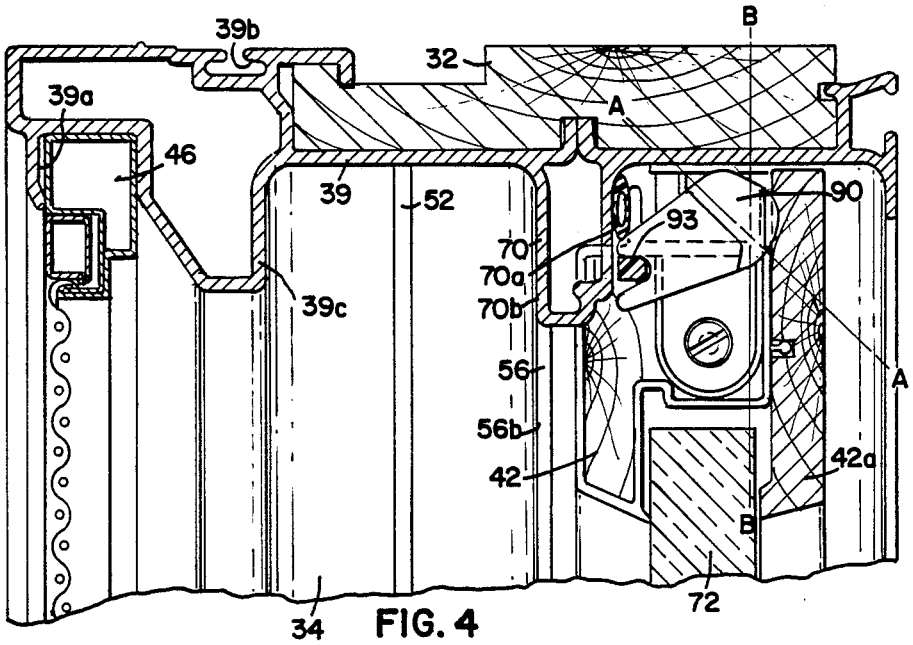
FIG. 4 is a cross-sectional view of the upper right corner portion of the window assembly of FIG. 1 as generally viewed along the Line 4—4 of FIG. 1.

Referring to FIG. 4, the side jamb extrusion 39 is illustrated as mounted to the underlying frame core 32. The structure of the left jamb 38 is a mirror image of that of jamb 39. Jamb 39 defines an inwardly projecting parting stop member 70 having inwardly and outwardly directed surfaces **70*a* and 70*b* respectively. The outer edge of the jamb extrusion 39 defines a groove 39*a* for retainably holding the frame 46 of the insect screen, and the outer edge of the jamb 39 defines a recessed groove 39*b* for securing a nailing flange to the outer edge of the jamb. The jamb 39 further defines an inwardly projecting extension 39*c* which provides a weather-protective shield for the edges of sash 40, the shield 39*c* being sufficiently spaced from the parting stop 70 so as to allow unimpeded movement of the sash 40 therebetween. The parting stop 70 and its counterpart (not illustrated) of jamb 38 form a continuous extension with the parting stops 56 and 66 respectively of the sill 34 and the head 36**.

In the preferred embodiment, the frames of the sash members 40 and 42 have a wooden core construction over which is extruded a vinyl coating, as generally illustrated in FIGS. 2–5. An inwardly directed extension of the vinyl-coated core frame portions of the sash form the outer glazing stop for the glass pane carried by the sashes 40 and 42 and generally designated at 72. The inner glazing stop of the sashes 40 and 42 is in the preferred embodiment, provided by wooden trim members 40*a* and 42*a* respectively appropriately secured to the vinyl-coated core portions of the sashes 40 and 42 respectively. The centermost edge (as viewed in FIG. 1) of the sash 40 defines a meeting-style stop or trim member, generally designated at 48 in FIG. 5, which terminates at its innermost edge with a flange 48*a* which extends inwardly along the entire vertical height of the sash 40. The lowermost edge of the sash 40 includes an extension portion generally designated at 49 in FIG. 3 which enhances the aesthetic appearance of the lower portion of sash 40 and provides protection from environmental elements for the guide track 52 and the glide member (to be hereinafter described) which rides thereon.

Each of the window sashes 40 and 42 has a continuous bulb-type weatherstrip member fixedly secured about its entire perimeter. The weatherstrip member secured to sash 42 is illustrated in compressed form along the outwardly directed surface of sash 42, at 43. The weatherstrip member for sash 40 is secured along its perimeter on its inwardly directed surface, illustrated in its compressed form at 41.

In the preferred embodiment, each of the corners of the sashes 40 and 42 has a glide member 80 mounted thereto, as illustrated in FIGS. 2–5. An exploded view of the glide member 80 configured according to a preferred embodiment of the invention, is illustrated in FIG. 7. A top view thereof is illustrated in FIG. 8.

Referring to FIGS. 7 and 8, the glide 80 is typical in construction of all of the glides used in the preferred embodiment, with the exception that depending upon the sash to which the glide is attached and to whether the glide is attached to the top or the bottom of the sash, the direction of the cam surfaces of the upper bearing member (hereinafter described in more detail) form mirror images of one another. Also, only glide members attached to the upper portions of sashes 40 and 42 include spring biasing (as will become apparent upon a more detailed description of the glides). The glide includes a housing portion 81 having a mounting flange 82 projecting at right angles thereto for securing the glide assembly to the corner edges of the sashes 40 and 42 as illustrated in FIGS. 2–5. In the preferred embodiment, the glide members 80 are secured to the sash members by means of a screw passing through the countersunk hole in the flange 82 and threadably secured within the wooden frame portions of the sashes 40 and 42. An eccentrically-shaped adjustment cam 83 having a plurality of cam lobe members is transversely mounted within the lower portion of the housing 81 and is rotatably adjustable by means of a screw-type shaft member 83*a* which is externally accessible (from the "back" side of the housing as illustrated in FIG. 7) when the glide is operatively mounted to a sash.

The upper portion of the housing 81 (as viewed in FIGS. 7 and 8) defines an opening 84 overlying the cam lobe members of the adjustment cam 83. The opening 84 is bordered at its sides by a pair of retaining members 85 formed of flexible plastic material which enables them to be spread apart for allowing access into the opening 84. The retaining bars 85 each has an alignment and restraining stud 85*a* located centrally thereof. A cylindrical sleeve member 86 is mounted to the housing 81 in alignment with the opening 84 and terminates at its lower end at a position overlying the adjustment cam 83 such that when the cam 83 is rotated about the shaft 83*a* so as to place its "widest" cam lobe surface in an upward direction, such cam surface will clear the bottom of the sleeve 86. The sleeve 86 defines an alignment keyway 86*a* longitudinally extending the length of the sleeve.

A cam follower member 88 is sized to slide through the opening 84 and longitudinally slidably engages the inner surface of the sleeve member 86. The outer periphery of the cam follower 88 has a pair of oppositely disposed grooves 88*a* which are configured to cooperatively mate with the alignment studs 85*a*. The outer periphery of the cam follower 88 also has an outwardly projected key member 88*b* that is configured to longitudinally slidably ride within the keyway 86*a* of the sleeve 86. The grooves 88*a* in cooperation with the alignment studs 85*a* align the key member 88*b* with the keyway groove 86*a*. When the key 88*b* operatively engages the keyway 86*a*, the cam follower 88 is prevented from rotating within the sleeve 86. The bottom surface of the cam follower 88 has a rib projection 88*c* diametrically extending across its lower surface for alignment with and cooperative engagement within the notches formed between the lobes of the adjustment cam 83. Accordingly, the cam follower 88 is vertically movable within the sleeve 86 and "follows" the adjustment cam 83 as it is rotated, but once fixed by the cam 83 at a desired vertical height, fixedly retains its position relative to the adjustment cam 83. The upper portion of the cam follower 88 forms a cylindrical shaft 88*d* over which an optional compression spring 89 rides. The compression spring 89 is only incorporated in those glides 80 that are connected to the top portions of sashes 40 and 42. It is omitted from those glides secured to the bottoms of the sashes.

An upper glide bearing member 90 defines a hollow lower stem portion 90*a* sized for cooperatively sliding over the upper shaft 88*d* of the cam follower 88 and the spring 89 and for vertical sliding movement within the sleeve 86. The lower portion of the cylindrical stem 90*a* includes a pair of opposed cammed alignment slots 90*b* which align with the alignment studs 85*a* of the retaining bars 85 to permit the stem 90*a* to be inserted within the sleeve 86. When the slots 90*b* are aligned with the studs 85*a* and the stem 90*a* is pushed downwardly through the opening 84, the retaining bars 85 are forced apart under the cam action of the alignment slots 90*b* to enable the retainer ring 90*c* on the stem to pass therebetween. Once the retaining ring 90*c* proceeds beyond the retaining bars 85, the bars 85 and the retaining ring 90*c* cooperatively prevent removal of the upper glide bearing assembly 90 from the housing and limit the upward travel of the stem 90*a* relative to the housing opening 84. If a spring 89 is inserted between the cam follower 88 and within the stem 90*a* of the upper glide bearing assembly 90, the spring will urge the upper glide assembly outwardly from the housing 81 as retained in its maximum travel by the retaining ring 90*c*.

The outer surface of the upper portion of the stem 90*a* is fluted, or contains detents, which cooperatively mate with the alignment studs 85*a* to restrainably prevent free rotation of the stem 90*a* about the stem axis within the sleeve 86. When the rotation pressure exerted on the stem 90*a* is sufficient to cause its fluted projections to "spread" the restraining bars 85 by pressure thereagainst directed through their alignment studs 85*a*, the stem 90*a* will rotate in discrete increments (i.e., in ratchet-style manner) as defined by the detents in the outer surface of the stem 90*a*. Accordingly, the stem 90*a* requires positive rotational force to be applied to it sufficient to overcome the bias force of the restraining bars 85 before it will rotate in either direction. Once the stem 90*a* is rotated, it will retain its last rotational position until sufficient rotational energy is once again imparted to the stem adequate to overcome the bias force of the restraining bars.

The upper portion of the glide bearing member 90 defines a pair of obliquely oriented guide track following channels sized to cooperatively accommodate the guide tracks 50, 52, 60 and 62. The upper bearing surface is configured to cooperatively engage the guide tracks at any angle between the two extreme channel positions illustrated by the Lines A—A and B—B in FIG. 7. When engaging a guide track at any time other than just before closure of a sash, the upper glide bearing surface will ride along its engaged guide track with the track positioned along the Line A—A. When the window sash approaches final closure (as hereinafter described) the glide bearing surface member will rotate about its stem axis, in the counterclockwise direction as viewed in FIG. 7, causing the glide upper bearing surface to slide along the engaged track guide until the glide engages the guide track along the Line B—B. Engagement of the guide track along the Line B—B corresponds to complete closure of the sash.

The outer periphery of the upper glide bearing portion 90 defines a receptor channel 92 for cooperatively engaging a pawl member 93. The pawl members 93 are positioned along the parting stops 56 and 66 and are mounted to the sill and head extrusions such that when a sash is moving in a closure direction and is within approximately one inch closure, the pawl 93 will engage the receptor channel 92 of the glide bearing member 90 to begin rotation of the bearing member 90 as the window sash longitudinally progresses further in the closing direction. The upper glide bearing portion 90 is eccentrically mounted relative to its stem 90*a* such that as the upper bearing portion begins to rotate, camming force is applied to it by the guide track with which it is in engagement. When the upper bearing portion illustrated in FIG. 7 is caused to rotate in the counterclockwise direction by pawl 93 engagement with the receptor channel 92, the retained guide track on which the glide surface is sliding will apply a transverse force to the upper bearing member through the cam surface 94. Such force will be transmitted through the stem 90*a* and to the housing 81, imparting a force to the glide 80 and the window sash to which it is attached which will cause the sash to move in a transverse direction as urged by the cam surface 93. Such motion will continue until the upper bearing member of the glide has rotated to a position wherein the guide track now rides along the Line B—B. At that point, the sash will be positioned in its closure position as illustrated in the FIGS. 2–5. Since such cam transferred forces are simultaneously transmitted to each corner of the sash, the entire sash will transversely move from the plane in which it had been longitudinally moving before the camming action was initiated, to a closure plane as illustrated in FIGS. 2–5). As the sash transversely moves toward closure, the seal members 41 or 43 associated with that sash will be compressed in sealing engagement against the frame parting stop members and/or against the other sash members, to form a positive, weathertight seal. Due to the retaining action of the glide members 80 provided by the retaining bars 85 and the detents on the bearing member stem 90*a*, once the guide stem has rotated to its "closed" position, it will be held there by such restraining action, causing the sash carried thereby to remain in its "closed" position (or at any desired position therebetween) until subsequent externally applied force is imparted to the sash by an operator in a longitudinal direction that would normally open the sash.

When opening a sash from the closure position, the opposite action will occur. The glide member initially engages its associated guide track along the Line B—B (FIG. 7). Upon application of an opening force to the sash by an operator, pushing on the sash in the longitudinal direction of the guide tracks, the forces transmitted through the sash to its glide members 80 will cause the upper bearing portions 90 of the glides 80 to begin rotating in a clockwise direction as viewed in FIG. 7, causing the cam surface 95 to exert pressure upon the engaged guide track which when transmitted through the glide assembly will impart a reverse transverse force to the sash, causing the sash to transversely move in a direction so as to release pressure from the weatherstrip seals, until the glide member has rotated sufficiently such that the retained glide track again is disposed along the Line A—A. In such position, the weatherstrip seals and other parts of the "opened" sash will be sufficiently spaced from the frame portions and from other sashes in the window assembly so as to prevent any rubbing engagement therebetween during subsequent movement of the sash in the opening direction.

As discussed above, the pawl members 93 are mounted to the frame extrusions adjacent the guide tracks thereof at longitudinal positions therealong so as to be engaged by the receptor channels 92 of the glides 80 when the window sashes are within approximately one inch of their closure positions. The pawl members 93 have an elongate base portion 93*a* which is sized to matingly fit between the guide tracks and their opposed parting stop member so as to securely fasten the pawl 93 in generally vertical relationship to the frame segment from which the pawl extends. The pawl member 93 also includes a retainer embossment 93*b* configured to engage a corresponding opening within the parting stop member against which the pawl lies, to fixedly secure the pawl to its associated parting stop member.

Figure 6:
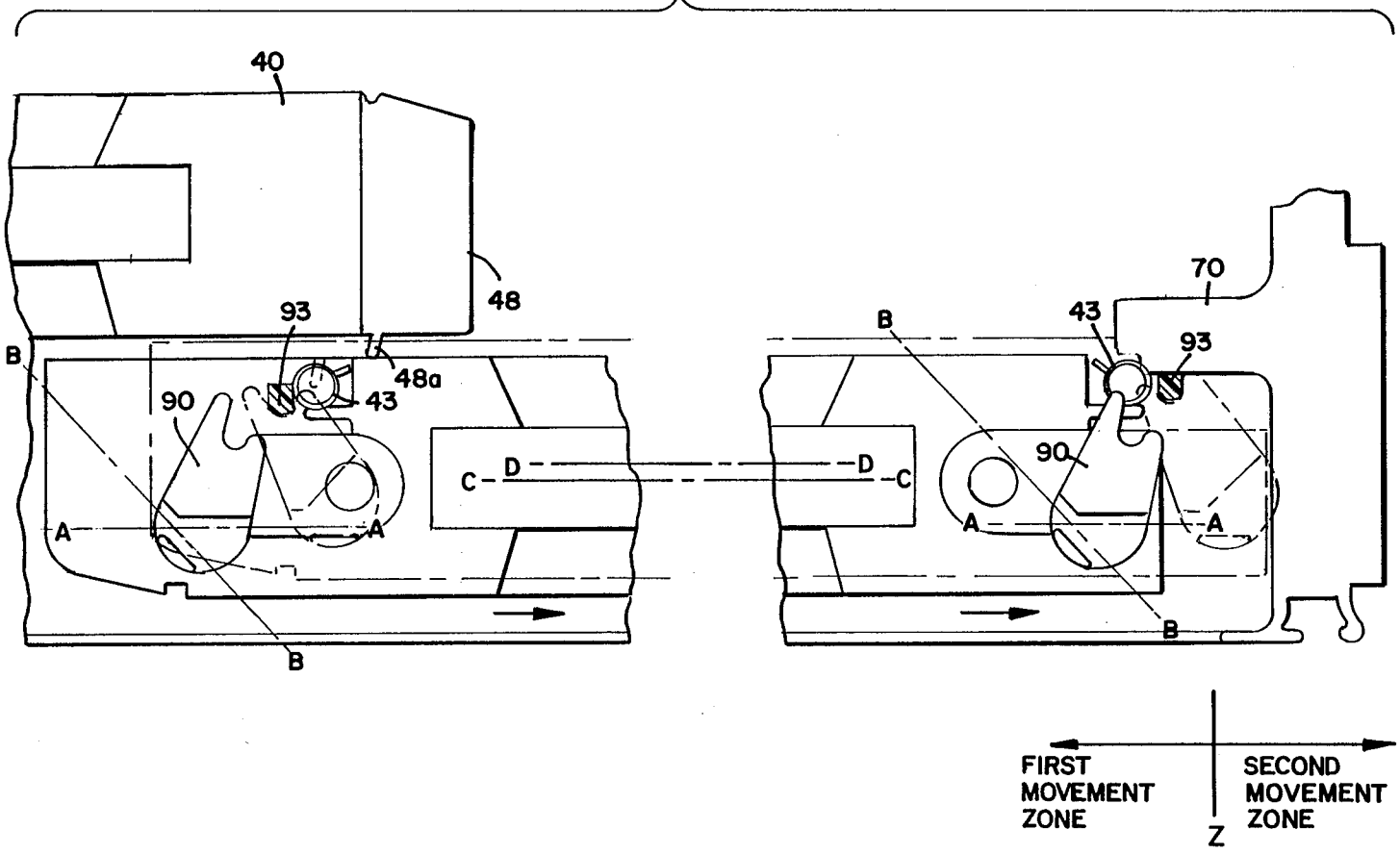
FIG. 6 is a diagrammatic illustration of the relative transverse movement of a sash member of a window assembly as illustrated in FIG. 1, as it appears when moving from a closed position to an open position and as it would appear generally from above the sash and with frame components of the window assembly removed.

The transverse motion provided by the cooperative glide and guide track principles of this invention is diagrammatically illustrated in FIG. 6. Referring thereto, the sash 42 is illustrated in bold lines, as it would appear when being moved in an open position, relative to the parting stop 70 and the second sash 40 which is illustrated in Fixed or closed position. The upper glide bearing members 90 are illustrated as detached from their respective pawl members 93 and are engaging the guide track along their Line A—A channel or path. In such position, the weatherstrip 43 is operative in its uncompressed form and the sash 42 freely clears the parting stop and flange projection 48*a* of the meeting-style stop member 48. In such position, the sash 42 is longitudinally movable between the upper and lower guide tracks 60 and 50 respectively generally in the vertical plane designated at C—C in FIG. 6. Movement of the sash 42 will continue in the C—C plane whenever the sash 42 is longitudinally positioned along the sill and head members, in a first movement zone prior to engagement of the rotating glide members 90 with the stationary pawl members 93. The first movement zone is indicated with respect to the leading edge of the window sash 42 in FIG. 6 as that region to the left of the zone indicator line "Z."

Figure 5:
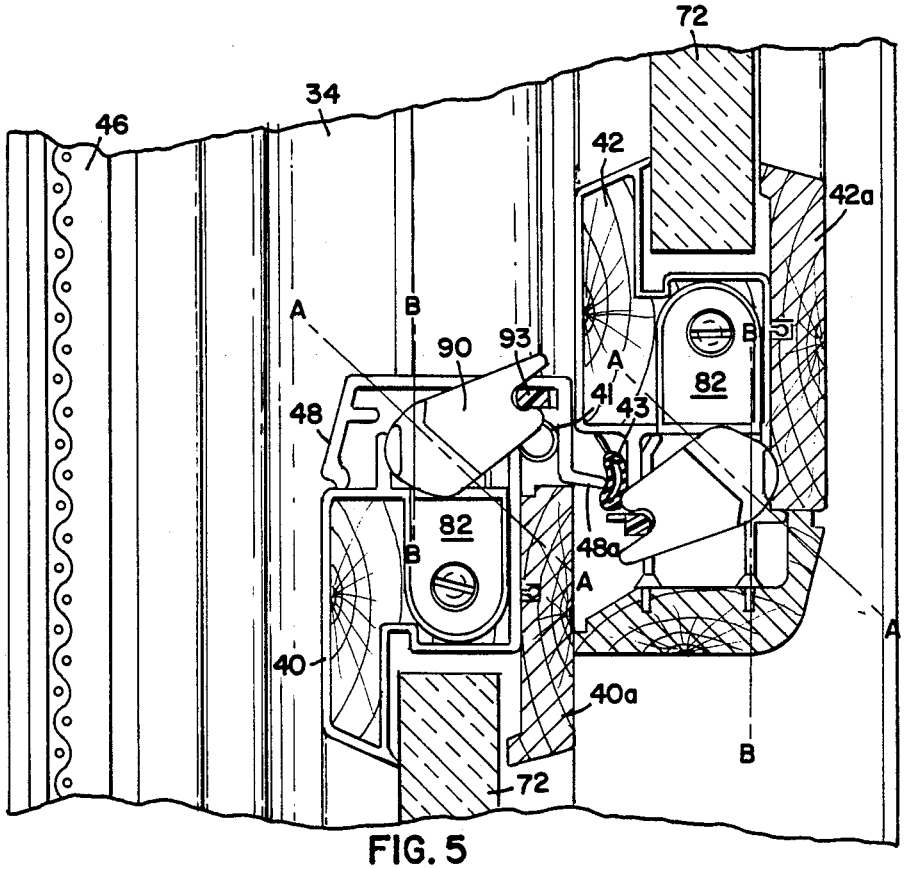
FIG. 5 is a cross-sectional view of the upper central sash portion of the window assembly of FIG. 1 as generally viewed along the Line 5—5 of FIG. 1.

When the leading edge of the sash 42 advances in the closing direction to the zone change indicator line "Z," at the point at which the glide bearing members 90 engage the stationary pawl members 93, subsequent movement of the window sash in the closure direction will be controlled by that camming action previously described with respect to the glide members 80 when operable within the Second Movement Zone. As the glide members 90 engage the pawl members 93 and are rotated about their respective pivotal axes, the pawl members transmit forces through the glide bearing members 90 and to the sash 42 to cause the entire sash to transversely move from the longitudinal position in the C—C plane to a final resting position in the D—D closure plane which occurs when the sash 42 is positioned in closure as indicated in FIGS. 4 and 5, and as diagrammatically indicated in dashed lines in FIG. 6. In the preferred embodiment, the simultaneous engagement of the glide bearing members 90 at all four corners of a sash during movement of the sash in the Second Movement Zone, the general plane of the sash being moved remains generally parallel to the planes C—C and D—D during the transverse motion phase. Those skilled in the art will readily appreciate that such uniform movement of the sash significantly enhances the ability to compressively engage the weatherstrip seal members of the sash with a minimum of sliding or frictional wear to the seals. Such movement also enables enhanced compression of the weatherstrip seal simultaneously around the entire perimeter of the sash over prior art methods using a combination of transverse and pivotal action to compress the weatherstrip seals.

While a specific embodiment of the invention has been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. A window construction of the type having at least one movable window sash, comprising:

(a) a frame having a sill;

(b) at least one sash mounted for sliding movement in said frame;

(c) a first guide track on said frame for slidably supporting said sash and for directing movement of the bottom of said sash along said frame, said first guide track projecting above said sill and longitudinally extending therealong;

(d) a second guide track on said frame in generally opposed relation to said first guide track for directing longitudinal movement of the top of said sash along said frame; and (e) glide means pivotally mounted to said sash and cooperatively mounting said sash between said first and said second guide tracks for supportively moving said sash along and between said opposed tracks; said glide means being operable in a first position within a first movement zone of said frame to guide said sash for movement along said first and second guide tracks in a first plane, and being automatically rotatable toward a second position within a second movement zone of said frame when said sash approaches a closure position to transversely move the entire sash to a second plane parallel to said first plane in a manner such that the general plane of said sash remains substantially parallel to said first plane during said transverse motion.

2. Window apparatus as recited in claim 1, wherein said pivotal glide means are arranged and configured to simultaneously control movement of all four corners of said sash.

3. A window construction as recited in claim 1, further including a second window sash operatively mounted in said frame generally parallel to said first sash; wherein said first and said second guide tracks and said glide means operatively longitudinally move said first sash in said first movement zone in spaced relationship to said second sash; and wherein said first and said second guide tracks and said glide means transversely move said first sash in said second movement zone toward and away from sealing engagement with said frame and said second sash.

4. A window construction as recited in claim 3, including seal means cooperatively aligned with said first sash, wherein said seal means is compressed between said first sash and said frame and said second sash when said first sash is positioned in said second plane, forming a weathertight seal therebetween.

5. The window construction as recited in claim 1, wherein said glide means comprises a plurality of glide members each having a glide surface for retainably sliding along respective ones of said guide tracks, wherein the glide surfaces of lowermost positioned ones of said glide members slidably support said window sash during movement thereof within said first and said second movement zones.

6. The window construction as recited in claim 5, wherein said glide members are further characterized by said glide surfaces being respectively contoured to form cam surfaces for bearing against said guide tracks, and further includes means for rotating said glide surfaces about respective pivot axes; and wherein said guide means further includes actuator means on said frame arranged to cooperatively engage said glide members for rotating said glide surfaces thereof about their respective pivot axes when said sash is moving in said second movement zone, whereby said cam surfaces bearing against said guide tracks during said rotation impart forces to said sash which cause said sash to transversely move between said first and said second planes.

7. The window construction as recited in claim 5, wherein said guide means includes height adjustment means for vertically adjusting the position of said first sash in said frame between said first and said second guide tracks.

8. A window construction of the type having at least one movable window sash, comprising:

(a) a frame having a sill;

(b) at least one sash mounted for sliding movement in said frame;

(c) a first guide track on said frame for slidably supporting said sash and for directing movement of the bottom of said sash along said frame, said first guide track projecting above said sill and longitudinally extending therealong;

(d) a second guide track on said frame in generally opposed relation to said first guide track for directing longitudinal movement of the top of said sash along said frame; and (e) glide means cooperatively mounting said sash between said first and said second guide tracks for moving said sash along and between said opposed tracks; said glide means being operable in a first movement zone of said frame to guide said sash for movement along said first and second guide tracks in a first plane, and being operable in a second movement zone of said frame when said sash approaches a closure position to automatically transversely move the entire sash to a second plane parallel to said first plane in a manner such that the general plane of said sash remains substantially parallel to said first plane during said transverse motion; wherein said glide means includes retainer means for enabling said window sash when positioned within said second movement zone to be retainably held at predetermined intervals between said first and said second planes.

9. A glide member for attachment to a sliding window sash, comprising:

(a) a housing configured for attachment to an edge of a window sash;

(b) a rotatable glide bearing defining a glide surface, said glide bearing having a stem portion rotatably supported by said housing, said glide surface being shaped to cooperatively engage and follow a guide track surface; and (c) retaining means cooperatively connected with said stem for restraining rotational movement of said stem within said housing, wherein rotation of said stem is retainably held at predetermined rotational angles about the stem axis.

10. The glide member as recited in claim 9, further including means operatively connected with said stem for adjusting the longitudinal position of said stem relative to said housing; whereby the glide surface is adjustably raised or lowered relative to said housing.

11. The glide member as recited in claim 10, wherein said adjustment means comprises a cam member rotatably mounted within said housing on an axis perpendicular to said stem axis, wherein the lower extension of said stem bears upon a cam support surface of said cam member.

12. The glide member as recited in claim 9, further including bias means mounted in said housing and cooperatively engaging said glide bearing member for urging said glide surface outwardly from the housing in the longitudinal direction of said stem.

13. The glide member as recited in claim 9, wherein said glide bearing member includes receptor means for cooperatively engaging a pawl member for rotating said glide bearing member about the axis of said stem.

14. The glide member as recited in claim 9, wherein said glide bearing surface is contoured to form a cam surface for bearing against said guide track surface, said cam surface being eccentrically positioned relative to said stem axis such that bearing forces applied to said cam surface are transmitted through said housing and to a window sash to which the housing is secured.

* * * * *

UNITED STATES PATENT AND TRADEMARK OFFICE

CERTIFICATE OF CORRECTION

PATENT NO. : 4,976,066

DATED : December 11, 1990

INVENTOR(S) : David D. Plummer, Hartmut Ginnow-Merkert

It is certified that error appears in the above-identified patent and that said Letters Patent is hereby corrected as shown below:

Column 7, Line 68, for "threedimensional" read --three-dimensional--

Column 11, Line 35, insert --of-- after "inch"

Column 11, Line 62, insert --(-- after "plane"

Column 14, Line 49, for "guide" read --glide--

Signed and Sealed this

Twenty-third Day of February, 1993

*Attest:*

STEPHEN G. KUNIN

*Attesting Officer*

*Acting Commissioner of Patents and Trademarks*